US007111334B2

(12) United States Patent
Chen

(10) Patent No.: US 7,111,334 B2
(45) Date of Patent: Sep. 26, 2006

(54) SPRAYING HEAD ASSEMBLY FOR MASSAGING TUB

(75) Inventor: Jack Ya Jyue Chen, Taichung (TW)

(73) Assignee: Minh Sang Tran, Cambridge (CA)

( * ) Notice: Subject to any disclaimer, the term of this patent is extended or adjusted under 35 U.S.C. 154(b) by 296 days.

(21) Appl. No.: 10/854,095

(22) Filed: May 25, 2004

(65) Prior Publication Data

US 2005/0262627 A1 Dec. 1, 2005

(51) Int. Cl.
*A61H 33/04* (2006.01)

(52) U.S. Cl. ..... 4/541.6

(58) Field of Classification Search ..... 4/492, 4/541.4, 541.5, 641.6
See application file for complete search history.

(56) References Cited

U.S. PATENT DOCUMENTS 5,063,620 A * 11/1991 Mersmann ..... 4/541.6
5,335,376 A * 8/1994 Kaldewei ..... 4/541.6

* cited by examiner

*Primary Examiner*—Robert M. Fetsuga
(74) *Attorney, Agent, or Firm*—Alan D. Kamrath; Nikolai & Mersereau, P.A.

(57) ABSTRACT

A spraying head assembly for a massaging tub includes a motor, a housing, a cap, and a cover. Thus, the spraying head assembly is assembled easily and conveniently, thereby facilitating a user mounting the spraying head assembly. In addition, the spraying head assembly can be detached easily by manually rotating and removing the cover and the cap, thereby facilitating maintenance of the spraying head assembly.

20 Claims, 6 Drawing Sheets

SPRAYING HEAD ASSEMBLY FOR MASSAGING TUB

BACKGROUND OF THE INVENTION

1. Field of the Invention

The present invention relates to a spraying head assembly, and more particularly to a spraying head assembly for a massaging tub.

2. Description of the Related Art

A conventional massaging tub shown in FIG. 6 comprises a tub body 1 having an inner wall provided with a circulation head 2, a drain head 3 and a plurality of nozzles 4, and a motor 5 mounted in the inside of the tub body 1. The motor 5 is connected to the circulation head 2 through a circulation pipe 6, and is connected to the nozzles 4 through a water outlet pipe 7. When the motor 5 is started, the water contained in the tub body 1 is drawn through the circulation head 2, the circulation pipe 6 and the water outlet pipe 7 and is then injected outward from the nozzles 4, thereby providing a massaging effect. Each of the nozzles 4 is connected to an air guide pipe 8 which introduces the ambient air into the nozzles 4 by the siphon effect, so that the water injected from the nozzle 4 contains air bubbles. The air guide pipe 8 is connected to an air flow regulating valve 9 to regulate the air inlet rate. The drain head 3 is provided with a control valve 3*a* to control operation of the drain head 3.

However, it is necessary to assemble the circulation pipe 6, the water outlet pipe 7 and the air guide pipe 8 in the tub body 1, thereby complicating the assembly process and increasing costs of assembly. In addition, the motor 5 is operated to draw the water contained in the tub body 1 through the circulation head 2, the circulation pipe 6, the water outlet pipe 7 and the nozzles 4, so that the motor 5 needs a larger power, and the water beam injected from the nozzles 4 is weakened. Further, the circulation head 2 is easily choked by an article, such as the towel or the like, so that the circulation head 2 forms a closed state, thereby wearing the motor 5 due to the idling operation.

SUMMARY OF THE INVENTION

In accordance with the present invention, there is provided a spraying head assembly, comprising a motor, a housing, a cap, and a cover, wherein:

the motor has an end face formed with a locking plate, a blade rotor is rotatably mounted on the end face of the motor;

the housing is mounted on the motor and includes an annular face plate and a socket extended from the face plate for mounting the blade rotor of the motor, the face plate of the housing has a periphery formed with two opposite oblique water outlet recesses, the socket of the housing has an inner wall formed with a flange having a first side formed with two opposite snap recesses and a second side formed with an annular mounting groove mounted on the locking plate of the motor;

the cap is mounted on the housing and includes a circular plate and a mounting ring extended from the circular plate and mounted in the socket of the housing, the circular plate has a center formed with a water inlet hole, the mounting ring has a periphery formed with two opposite water outlet openings each aligning with the respective water outlet recess of the face plate, the mounting ring has an end face formed with two opposite snapping blocks each snapped into a respective one of the snap recesses of the socket of the housing; and the cover is mounted on the cap and has an inside formed with a mounting recess mounted on the circular plate of the cap, the cover has a periphery formed with two opposite arcuate concave portions each aligning with the respective water outlet recess of the face plate.

The primary objective of the present invention is to provide a spraying head assembly for a massaging tub.

Another objective of the present invention is to provide a spraying head assembly that is assembled easily and conveniently, thereby facilitating a user mounting the spraying head assembly.

A further objective of the present invention is to provide a spraying head assembly that is detached easily by manually rotating and removing the cover and the cap, thereby facilitating maintenance of the spraying head assembly.

A further objective of the present invention is to provide a spraying head assembly, wherein it is unnecessary to provide pipes in the massaging tub, thereby decreasing costs of fabrication.

A further objective of the present invention is to provide a spraying head assembly, wherein the blade rotor is rotated to produce a suction force to draw the water contained in the massaging tub to flow through the water inlet slots of the cover and the water inlet hole of the cap into the inside of the housing to form a vortex so as to pressurize the water flow, thereby forming strong water beams which are injected outward from the two oblique water outlet recesses of the housing.

Further benefits and advantages of the present invention will become apparent after a careful reading of the detailed description with appropriate reference to the accompanying drawings.

DETAILED DESCRIPTION OF THE INVENTION

Figure 1:
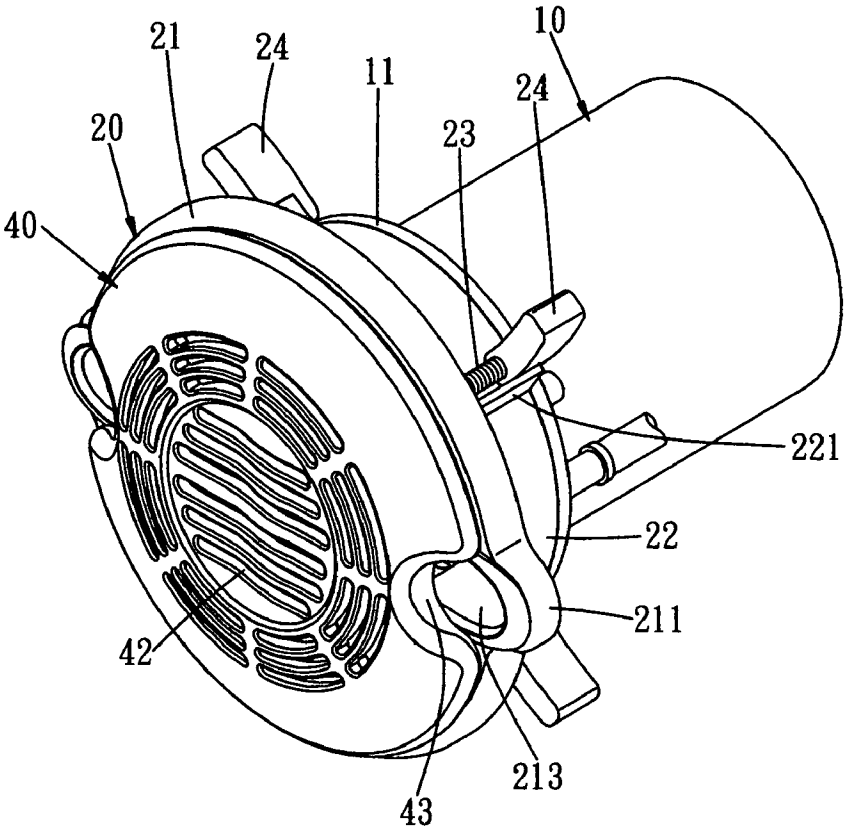
FIG. 1 is a perspective view of a spraying head assembly in accordance with the preferred embodiment of the present invention.
Figure 2:
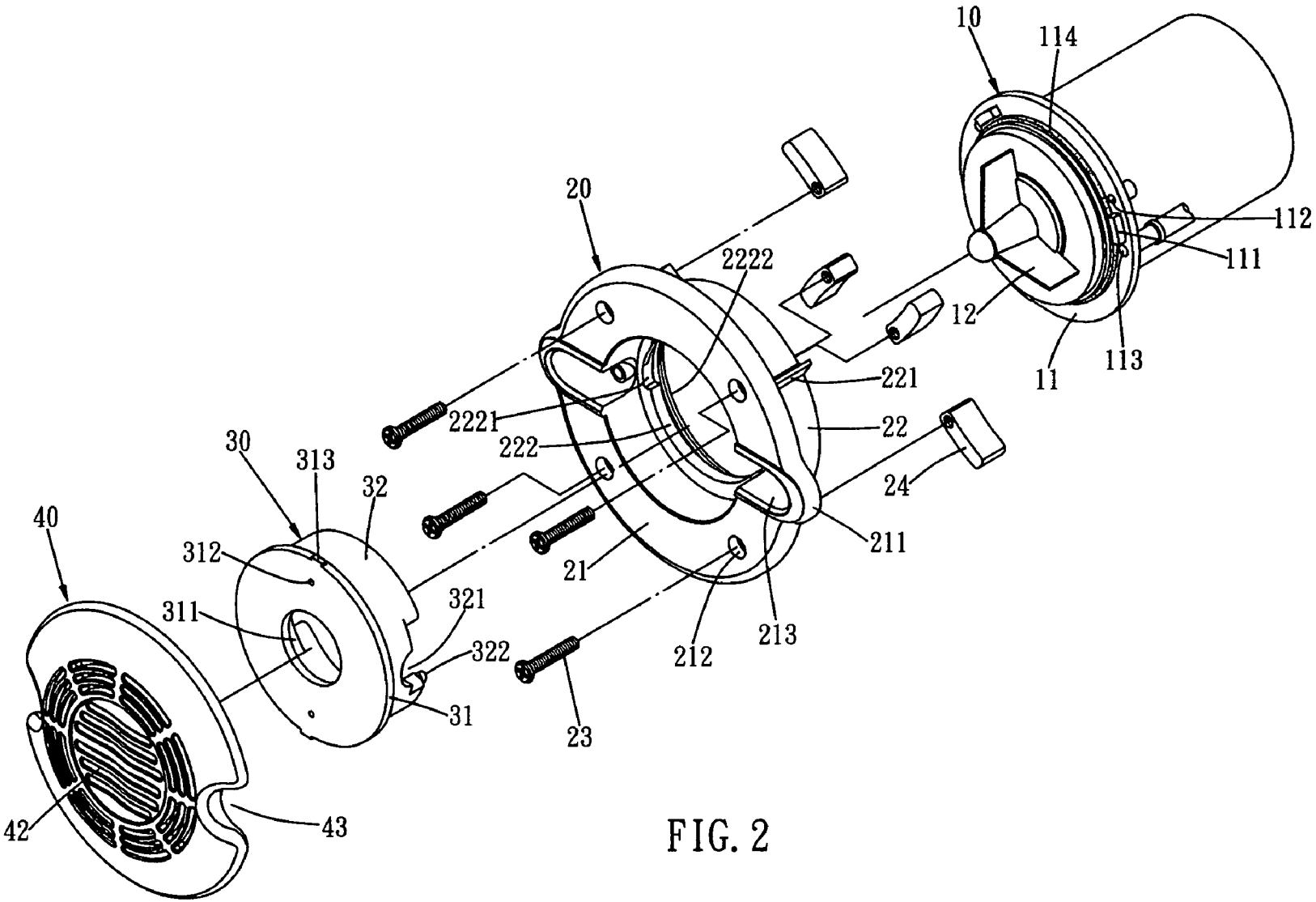
FIG. 2 is an exploded perspective view of the spraying head assembly as shown in FIG. 1.
Figure 3:
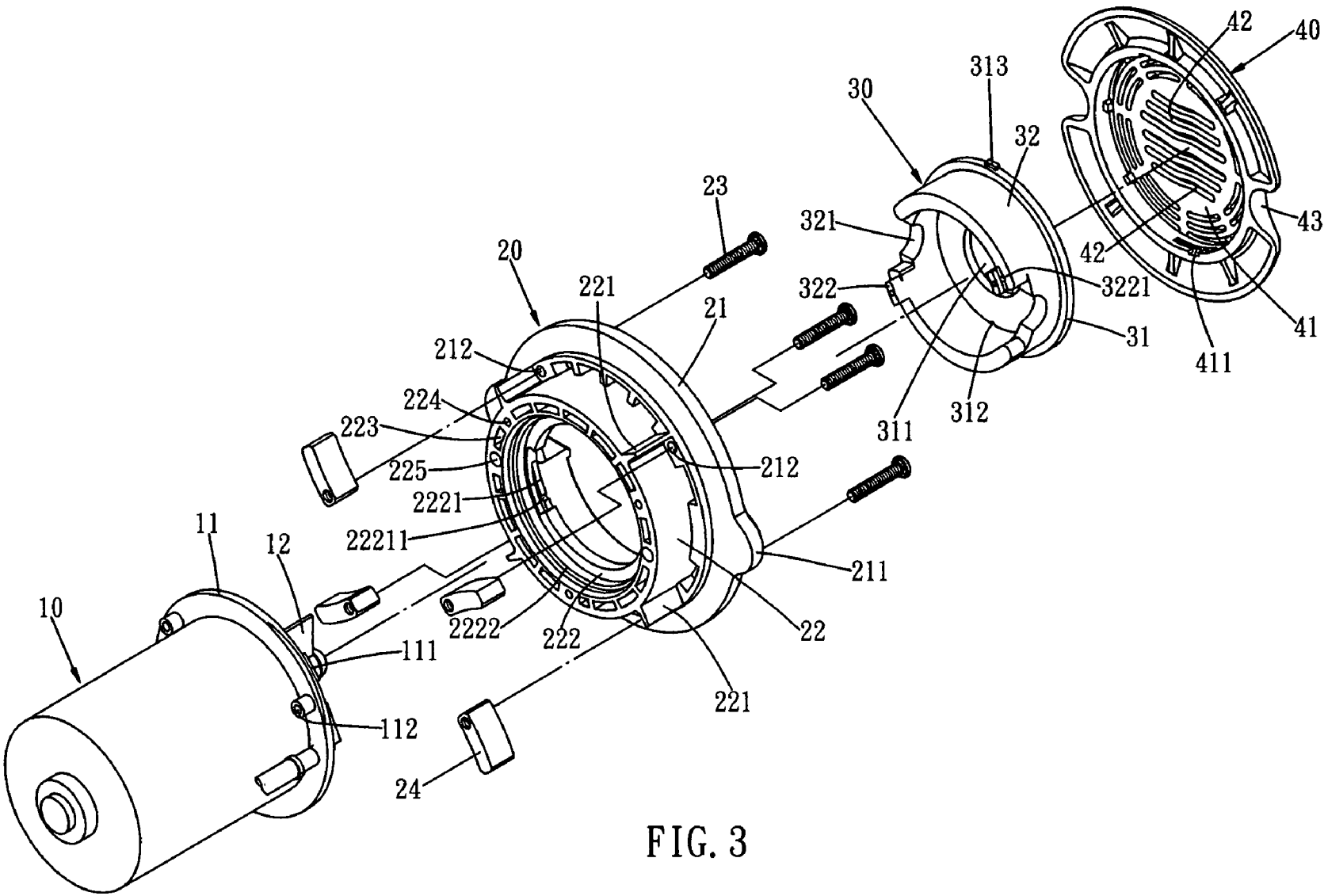
FIG. 3 is an exploded perspective view of the spraying head assembly as shown in FIG. 1.
Figure 4:
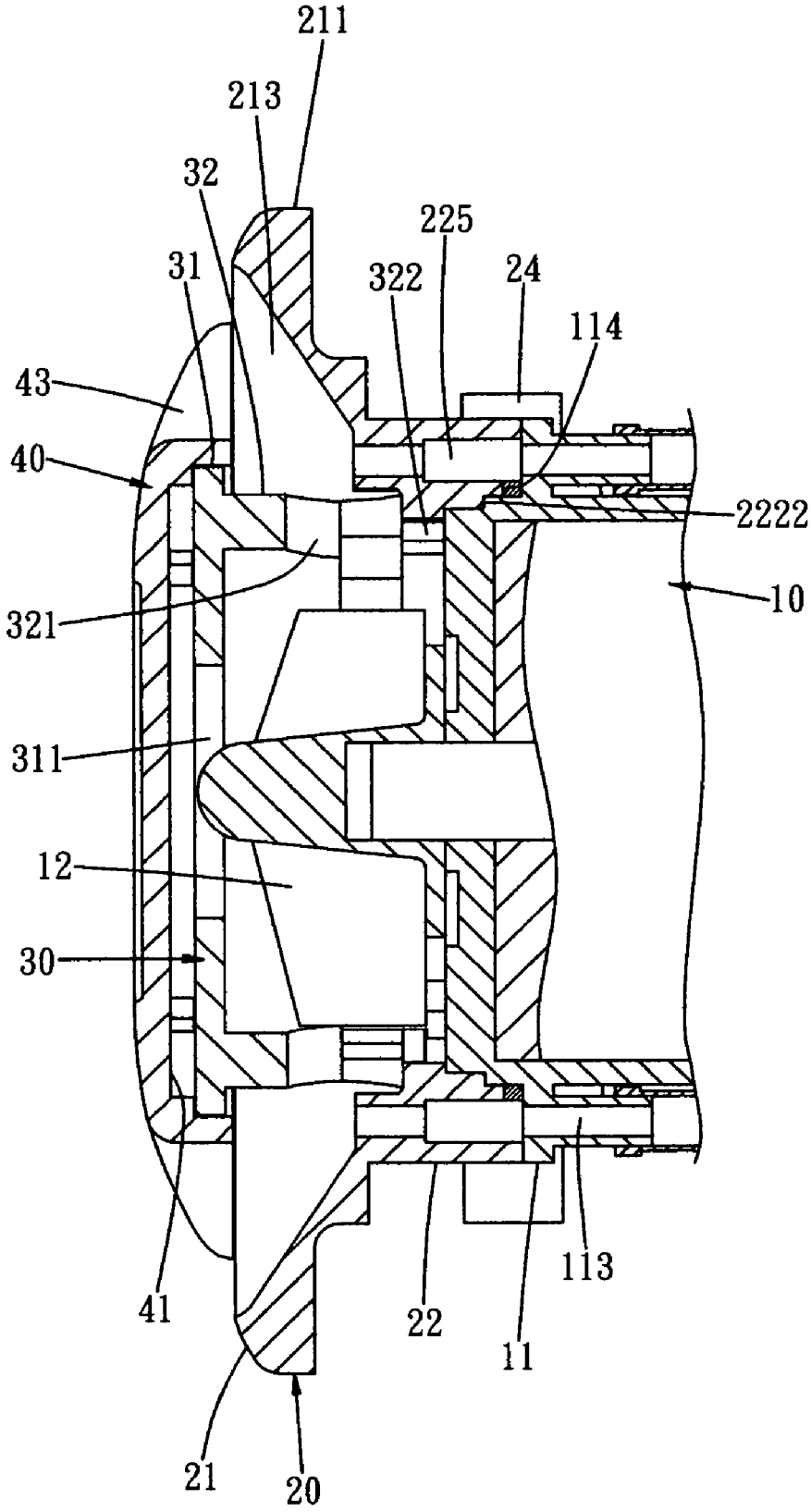
FIG. 4 is a partially cut-away side plan cross-sectional view of the spraying head assembly as shown in FIG. 1.

Referring to the drawings and initially to FIGS. 1–4, a spraying head assembly for a massaging tub in accordance with the preferred embodiment of the present invention comprises a motor 10, a housing 20, a cap 30, and a cover 40.

The motor 10 has an end face formed with a circular locking plate 11 protruded outward therefrom. The locking plate 11 of the motor 10 has a stepped shape and is formed with a plurality of protruding positioning blocks 111, a plurality of fixing holes 112, and a plurality of air inlet holes 113. Each of the fixing holes 112 of the locking plate 11 of the motor 10 is located adjacent to a respective one of the positioning blocks 111. An O-ring 114 is mounted on the locking plate 11 of the motor 10. A blade rotor 12 is rotatably mounted on the end face of the motor 10.

The housing 20 is mounted on the motor 10 and includes an annular face plate 21 and a socket 22 extended from the face plate 21 and rested on the locking plate 11 of the motor 10 for mounting the blade rotor 12 of the motor 10.

The face plate 21 of the housing 20 has a periphery formed with two opposite arcuate convex portions 211 and two opposite oblique water outlet recesses 213. The face plate 21 has an end face formed with a plurality of locking holes 212 for passage of a plurality of locking screws 23 each screwed into a resting plate 24.

The socket 22 of the housing 20 has a periphery formed with a plurality of arcuate catch plates 221 each aligning with a respective one of the locking holes 212 of the face plate 21. The socket 22 of the housing 20 has an inner wall formed with a radially inward extended flange 222 having a first side formed with two opposite snap recesses 2221 each formed with a positioning notch 22211 and a second side formed with an annular mounting groove 2222 mounted on the locking plate 11 of the motor 10 and rested on the O-ring 114. The socket 22 of the housing 20 has an end face formed with a plurality of positioning recesses 223, a plurality of screw bores 224 and two ventilating holes 225.

Each of the positioning blocks 111 of the locking plate 11 of the motor 10 is positioned in a respective one of the positioning recesses 223 of the socket 22 of the housing 20. Each of the screw bores 224 of the socket 22 of the housing 20 is engaged with a respective one of the fixing holes 112 of the locking plate 11 of the motor 10 by a locking screw (not shown), so that the socket 22 of the housing 20 is fixed on the locking plate 11 of the motor 10. Each of the ventilating holes 225 of the socket 22 of the housing 20 communicates with a respective one of the air inlet holes 113 of the locking plate 11 of the motor 10. Each of the ventilating holes 225 of the socket 22 communicates with the respective water outlet recess 213 of the face plate 21.

The cap 30 is mounted on the housing 20 and includes a circular plate 31 and a mounting ring 32 extended from the circular plate 31.

The circular plate 31 of the cap 30 has a center formed with a water inlet hole 311 and has an end face formed with two opposite water draining holes 312 each located beside the water inlet hole 311. The circular plate 31 of the cap 30 has a periphery formed with two opposite locking blocks 313.

The mounting ring 32 of the cap 30 is mounted in the socket 22 of the housing 20. The mounting ring 32 of the cap 30 has an end face formed with two opposite snapping blocks 322 each snapped into a respective one of the snap recesses 2221 of the socket 22 of the housing 20 and each formed with a positioning boss 3221 locked in the positioning notch 22211 of the respective snap recess 2221. The mounting ring 32 of the cap 30 has a periphery formed with two opposite water outlet openings 321 each aligning with the respective water outlet recess 213 of the face plate 21 of the housing 20, and each of the snapping blocks 322 of the mounting ring 32 of the cap 30 is located beside a respective one of the water outlet openings 321.

The cover 40 having a disk shape is mounted on the cap 30. The cover 40 has an inside formed with a mounting recess 41 mounted on the circular plate 31 of the cap 30 and has an end face formed with a plurality of elongated water inlet slots 42 each communicating with the mounting recess 41. The mounting recess 41 of the cover 40 has a periphery formed with two opposite snapping notches 411, and each of the two opposite locking blocks 313 of the circular plate 31 of the cap 30 is snapped into a respective one of the snapping notches 411 of the cover 40. The cover 40 has a periphery formed with two opposite arcuate concave portions 43 each aligning with the respective water outlet recess 213 of the face plate 21 of the housing 20.

Figure 5:
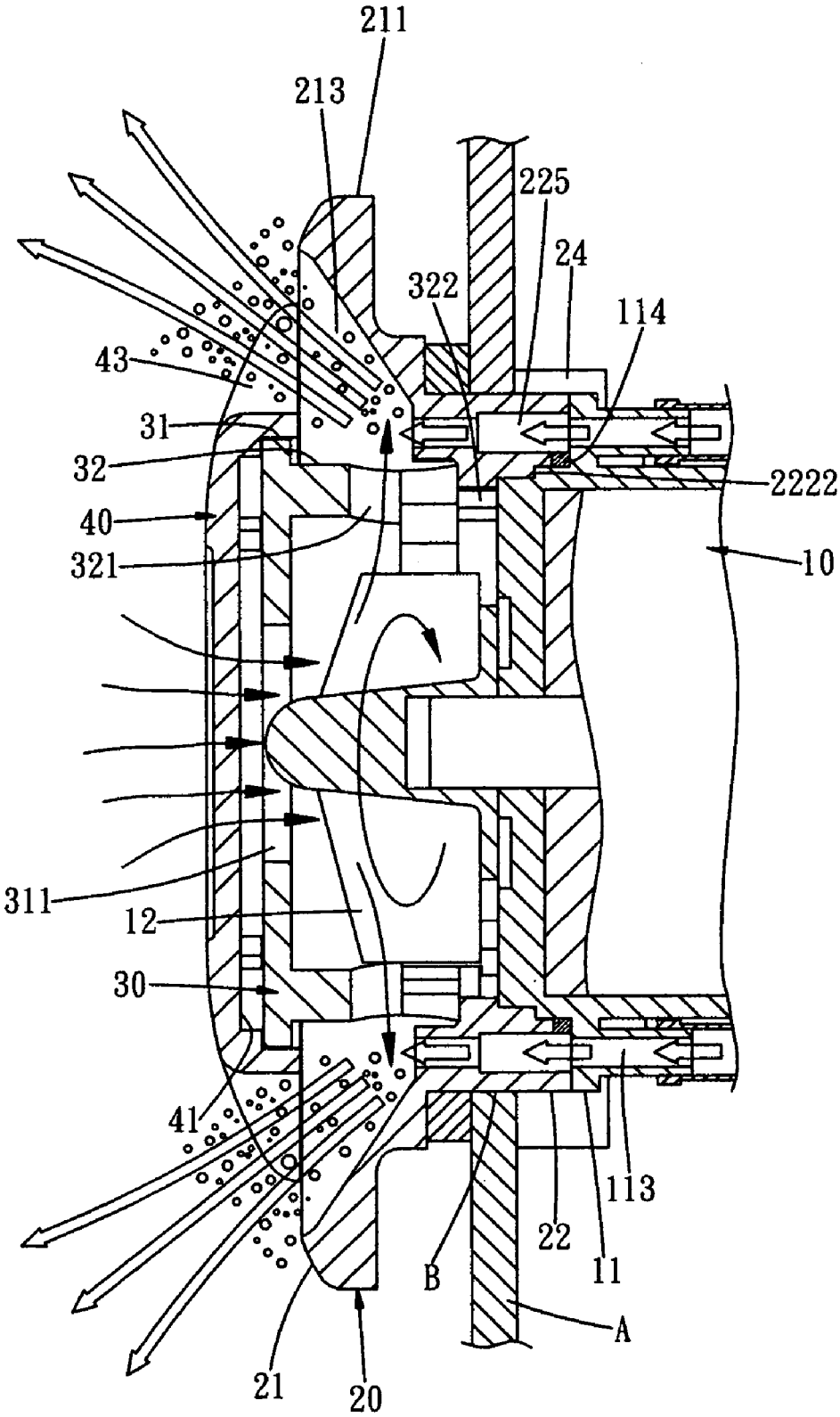
FIG. 5 is a schematic operational view of the spraying head assembly as shown in FIG. 4 in use.
Figure 6:
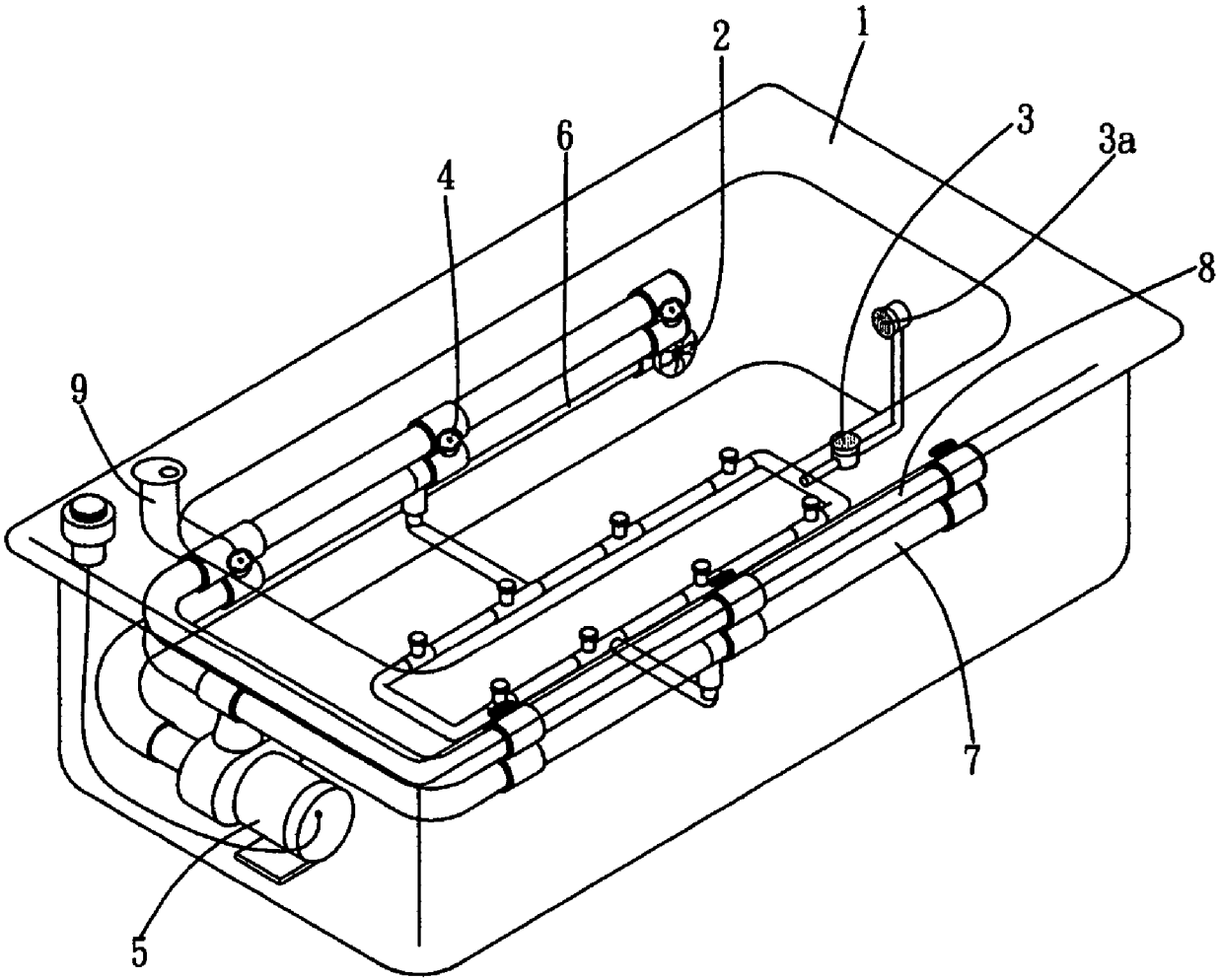
FIG. 6 PRIOR ART
FIG. 6 is a perspective view of a conventional massaging tub in accordance with the prior art.

In operation, referring to FIG. 5 with reference to FIGS. 1–4, the spraying head assembly is mounted in a mounting hole "B" of an inner wall "A" of the massaging tub, and the locking screws 23 are rotated to drive the resting plates 24 to press the inner wall "A" of the massaging tub, thereby fixing the spraying head assembly on the inner wall "A" of the massaging tub.

When the motor 10 is operated, the blade rotor 12 is rotated by the rotation shaft (not shown) of the motor 10 to produce a suction force to draw the water contained in the massaging tub to flow through the water inlet slots 42 of the cover 40 and the water inlet hole 311 of the cap 30 into the inside of the housing 20 to form a vortex so as to pressurize the water flow, thereby forming multiple strong water beams which are injected outward from the two opposite oblique water outlet recesses 213 of the housing 20.

At this time, the ambient air is drawn through the air inlet holes 113 of the locking plate 11 of the motor 10 and the ventilating holes 225 of the socket 22 of the housing 20 into the two opposite oblique water outlet recesses 213 of the housing 20 by the syphon effect, so that the water beams are mixed with the air to form bubbles.

In addition, the used water contained in the massaging tub flows through the housing 20 and the water draining holes 312 of the cap 30 and is drained outward from the cover 40, so that the used water is not accumulated in the housing 20.

Accordingly, the spraying head assembly is assembled easily and conveniently, thereby facilitating a user mounting the spraying head assembly. In addition, the spraying head assembly is detached easily by manually rotating and removing the cover 40 and the cap 30, thereby facilitating maintenance of the spraying head assembly. Further, it is unnecessary to provide pipes in the massaging tub, thereby decreasing costs of fabrication. Further, the blade rotor 12 is rotated to produce a suction force to draw the water contained in the massaging tub to flow through the water inlet slots 42 of the cover 40 and the water inlet hole 311 of the cap 30 into the inside of the housing 20 to form a vortex so as to pressurize the water flow, thereby forming strong water beams which are injected outward from the two oblique water outlet recesses 213 of the housing 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spraying head assembly, comprising a motor, a housing, a cap, and a cover, wherein:

the motor has an end face formed with a locking plate, a blade rotor is rotatably mounted on the end face of the motor;

the housing is mounted on the motor and includes an annular face plate and a socket extended from the face plate for mounting the blade rotor of the motor, the face plate of the housing has a periphery formed with two opposite oblique water outlet recesses, the socket of the housing has an inner wall formed with a flange having a first side formed with two opposite snap recesses and a second side formed with an annular mounting groove mounted on the locking plate of the motor;

the cap is mounted on the housing and includes a circular plate and a mounting ring extended from the circular plate and mounted in the socket of the housing, the circular plate has a center formed with a water inlet hole, the mounting ring has a periphery formed with two opposite water outlet openings each aligning with the respective water outlet recess of the face plate, the mounting ring has an end face formed with two opposite snapping blocks each snapped into a respective one of the snap recesses of the socket of the housing; and the cover is mounted on the cap and has an inside formed with a mounting recess mounted on the circular plate of the cap, the cover has a periphery formed with two opposite arcuate concave portions each aligning with the respective water outlet recess of the face plate.

2. The spraying head assembly in accordance with claim 1, wherein the socket of the housing has an end face formed with a plurality of positioning recesses, and the locking plate of the motor is formed with a plurality of protruding positioning blocks each positioned in a respective one of the positioning recesses of the socket.

3. The spraying head assembly in accordance with claim 2, wherein the locking plate of the motor is formed with a plurality of fixing holes each located adjacent to a respective one of the positioning blocks.

4. The spraying head assembly in accordance with claim 1, wherein the locking plate of the motor is formed with a plurality of air inlet holes, and the socket of the housing has an end face formed with two ventilating holes each communicating with a respective one of the air inlet holes of the locking plate.

5. The spraying head assembly in accordance with claim 4, wherein each of the ventilating holes of the socket communicates with the respective water outlet recess of the face plate.

6. The spraying head assembly in accordance with claim 1, wherein the locking plate of the motor is formed with a plurality of fixing holes, and the socket of the housing has an end face formed with a plurality of screw bores each engaged with a respective one of the fixing holes of the locking plate.

7. The spraying head assembly in accordance with claim 1, wherein the periphery of the face plate of the housing is formed with two opposite arcuate convex portions.

8. The spraying head assembly in accordance with claim 1, wherein the face plate has an end face formed with a plurality of locking holes for passage of a plurality of locking screws each screwed into a resting plate.

9. The spraying head assembly in accordance with claim 8, wherein the socket has a periphery formed with a plurality of arcuate catch plates each aligning with a respective one of the locking holes of the face plate.

10. The spraying head assembly in accordance with claim 1, further comprising an O-ring mounted on the locking plate of the motor.

11. The spraying head assembly in accordance with claim 10, wherein the mounting groove of the socket of the housing is rested on the O-ring.

12. The spraying head assembly in accordance with claim 1, wherein each of the snap recesses of the socket of the housing is formed with a positioning notch, and each of the two opposite snapping blocks of the mounting ring of the cap is formed with a positioning boss locked in the positioning notch of the respective snap recess.

13. The spraying head assembly in accordance with claim 1, wherein each of the snapping blocks of the mounting ring is located beside a respective one of the water outlet openings.

14. The spraying head assembly in accordance with claim 1, wherein the circular plate of the cap has an end face formed with two opposite water draining holes each located beside the water inlet hole.

15. The spraying head assembly in accordance with claim 1, wherein the cover has an end face formed with a plurality of elongated water inlet slots each communicating with the mounting recess.

16. The spraying head assembly in accordance with claim 1, wherein the mounting recess of the cover has a periphery formed with two opposite snapping notches, and the circular plate of the cap has a periphery formed with two opposite locking blocks each snapped into a respective one of the two snapping notches of the cover.

17. The spraying head assembly in accordance with claim 1, wherein the locking plate of the motor has a stepped shape.

18. The spraying head assembly in accordance with claim 1, wherein the locking plate of the motor is circular.

19. The spraying head assembly in accordance with claim 1, wherein the cover has a disk shape.

20. The spraying head assembly in accordance with claim 1, wherein the socket of the housing is rested on the locking plate of the motor.

* * * * *